US011713923B2

(12) United States Patent
Bekker

(10) Patent No.: US 11,713,923 B2
(45) Date of Patent: Aug. 1, 2023

(54) HORIZONTAL SURFACE DRYER

(71) Applicant: Marthinus Jacobus Bekker, Fuquay-Varina, NC (US)

(72) Inventor: Marthinus Jacobus Bekker, Fuquay-Varina, NC (US)

( * ) Notice: Subject to any disclaimer, the term of this patent is extended or adjusted under 35 U.S.C. 154(b) by 295 days.

(21) Appl. No.: 17/166,510

(22) Filed: Feb. 3, 2021

(65) Prior Publication Data

US 2022/0243984 A1 Aug. 4, 2022

(51) Int. Cl.

| | |
|---|---|
| ***F26B 25/06*** | (2006.01) |
| ***F26B 9/00*** | (2006.01) |
| ***F26B 21/02*** | (2006.01) |
| ***F26B 21/00*** | (2006.01) |

(52) U.S. Cl.

CPC ..... *F26B 25/066* (2013.01); *F26B 9/00* (2013.01); *F26B 21/001* (2013.01); *F26B 21/02* (2013.01)

(58) Field of Classification Search

CPC ..... F26B 25/006; F26B 9/00; F26B 21/001; F26B 21/02

USPC ..... 34/443

See application file for complete search history.

(56) References Cited

U.S. PATENT DOCUMENTS

| | | | | | |
|---|---|---|---|---|---|
| 495,558 | A * | 4/1893 | Machado | A45D 1/04 | 34/101 |
| 1,997,994 | A * | 4/1935 | Bishinger | A45D 20/22 | 392/383 |
| 2,012,473 | A * | 8/1935 | Mcelroy | A45D 20/22 | 34/100 |
| 2,747,296 | A * | 5/1956 | Mitchell | A45D 20/22 | 34/90 |
| 2,776,497 | A * | 1/1957 | Hudson | A45D 20/22 | 34/90 |
| 3,757,429 | A * | 9/1973 | Sumino | A45D 20/44 | 392/382 |
| 5,619,808 | A * | 4/1997 | Pabst | F26B 21/004 | 34/640 |
| 5,802,735 | A * | 9/1998 | Schoonhoven | F26B 9/066 | 34/174 |
| 5,878,508 | A * | 3/1999 | Knoll | A01J 11/04 | 34/211 |
| 10,006,707 | B1 * | 6/2018 | Wiley | A45D 20/14 | |
| 2022/0243984 | A1 * | 8/2022 | Bekker | F26B 21/10 | |

FOREIGN PATENT DOCUMENTS

| | | | | |
|---|---|---|---|---|
| CN | 108912193 | A * | 11/2018 | C07J 7/0045 |

* cited by examiner

*Primary Examiner* — Stephen M Gravini
(74) *Attorney, Agent, or Firm* — James G. Passe; Passe Intellectual Property, LLC

(57) ABSTRACT

A hands-free device for drying wet surfaces that are essentially horizontal, having a heating element and a fan oriented vertically to blow heated air downward and is housed in a vertically oriented case containing a plurality of vents and legs that allow for the escape of gas, heat, or air.

8 Claims, 3 Drawing Sheets

HORIZONTAL SURFACE DRYER

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a device for drying surfaces. In particular, it is a hands-free device for drying wet surfaces that are essentially horizontal.

Description of Related Art

The need to dry wet surfaces is well known. Whether from urine spills on the carpet to general carpet drying of spots or paint drying (especially on small hobby models), the need to dry things is always a challenge. Current methods involve the use of large and expensive equipment to provide a hands-off drying system, while small hand-held dryers require the user to hold the dryer. There is a need for a more cost effective, essentially horizontal surface drying device that is hands-free.

BRIEF SUMMARY OF THE INVENTION

The present invention relates to a vertically oriented hot air dryer which can stand on its own without the need of a user holding it. This solves the problems associated with hair dryers and other drying devices that are used on surfaces such as carpets, floors, model kits, and small painted objects.

Accordingly, in one embodiment, there is a hands-free device for drying an essentially horizontal surface comprising:

a) a heating element;
b) a fan oriented vertically to blow heat from the heating element downward;
c) a power source; and
d) a vertically oriented case housing the fan and heating element and having a plurality of legs designed to raise the vertically oriented case partially off the surface to be dried to create vent holes.

DETAILED DESCRIPTION OF THE INVENTION

Figure 1:
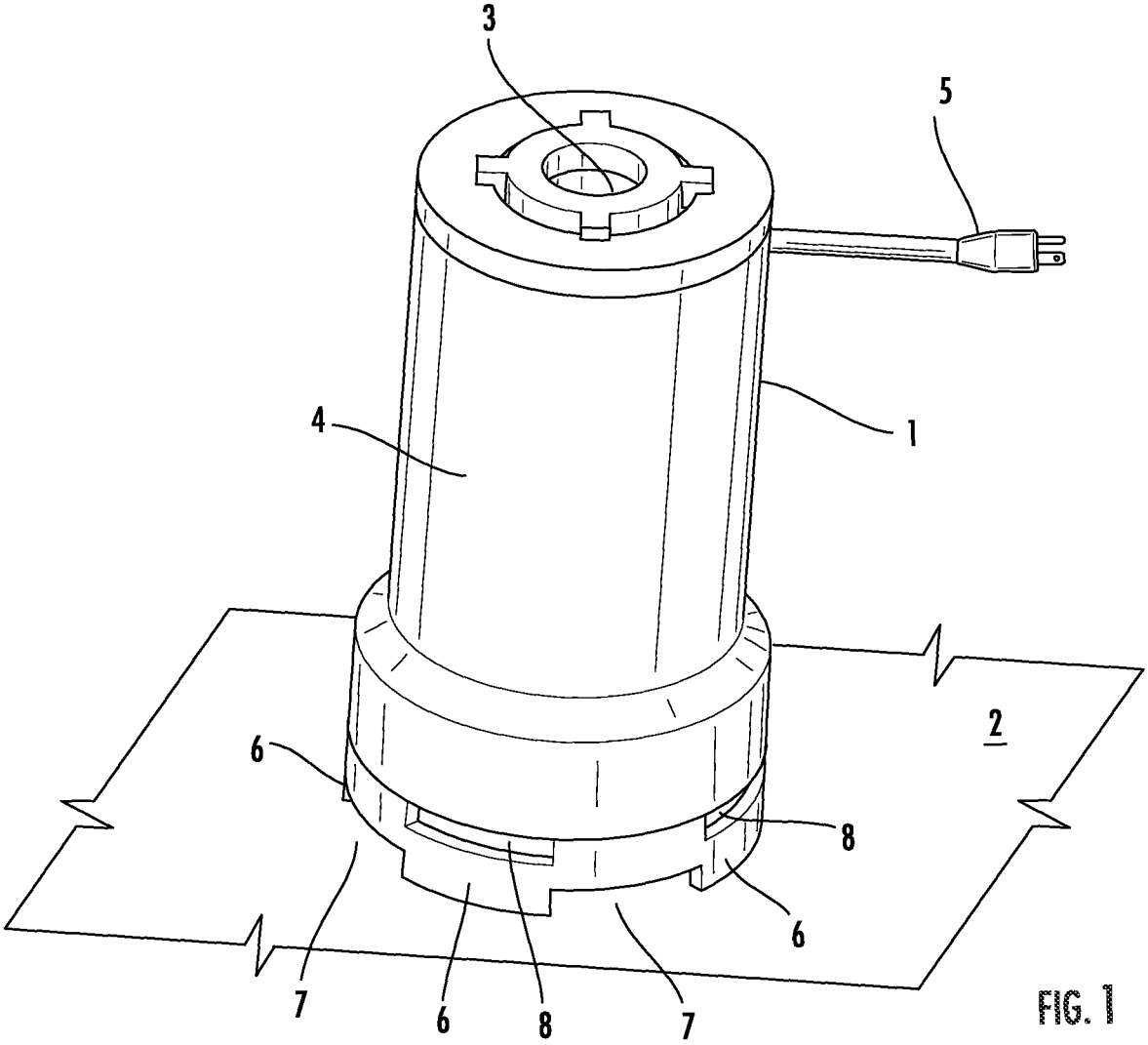
FIG. 1 is a perspective view of the hands-free drying device of the present invention.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean ±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "device for hands-free drying" refers to a combination of heating element and fan designed to dry an essentially horizontal surface. The elements are housed in a vertically oriented case such that the device's vertically oriented case can sit on the essentially horizontal surface in a hands-free manner. There are legs on the bottom of the housing designed to lift the device up and provide vent holes to aid in venting atomized liquids and not overheat the essentially horizontal surface.

As used herein, the term "essentially horizontal surface" refers to surfaces that are within plus or minus 10% of being perfectly horizontal. It also refers to small objects which may not have a flat surface, but will still sit horizontally, such that the device can be placed on or over the small object. Examples of such surfaces include carpets, floors, small models (like an airplane model), table tops, and the like.

As used herein, the term "heating element" refers to an electric (AC or DC) device which generates heat. It is the part of an electric heating appliance in which the electrical energy is transformed into heat. In one embodiment, the heating element is a resistor tuned to produce as much heat as possible when current is passing through it. In one embodiment, the heat generated is from about 50° C. to about 58° C. (the temperature setting can be changed if needed during manufacturing therefore allowing a wider range if needed). The heating element is contained in a vertically oriented case.

As used herein, the term "fan" refers to an apparatus with rotating blades that creates a current of air for transferring heat from the heating element to the object being dried.

As used herein, the term "power source" refers to an electric circuit running from AC power sources to DC power sources, which is used to power the fan and the heating element. Electric power is the rate at which electrical energy is transferred by an electric circuit; usually produced by AC current or batteries.

As used herein, the term "vertically oriented case" refers to a case which houses the heating element and the fan pointing downward, wherein the housing will sit on the essentially horizontal surface and blow heated air downward to dry the surface below it. In one embodiment, the vertically oriented case is columnar (e.g., the case shown in FIG. 1).

As used herein, the term "legs" refers to supports around a bottom edge of the housing, such that the case is raised up in a manner that there are vent holes in between the legs as can clearly be seen in FIG. 1.

As used herein, the term "vent holes" refers to openings on the vertical case. There are one or more hole for the escape of gas, heat, or air, They can be the spaces between the legs on the case or be additionally added holes positioned on the case above the legs.

Drawings

Now referring to the drawings, FIG. 1 is a perspective view of the hands-free drying device of the present invention. Shown is a hands-free drying device 1 sitting on an essentially horizontal surface 2. In this view, while we cannot see the heating element and fan, we see air inlet vent 3 on the top of vertically oriented case 4. The power source for this example is AC current supplied from plug 5 when plugged into an outlet. Batteries or the like could be substituted. At the bottom of vertically oriented case 4, we see legs 6 which elevate the bottom of the vertically oriented case 4 (which in this view is cylindrical) and create vent holes 7. Also shown are additional vent holes 8.

Figure 2:
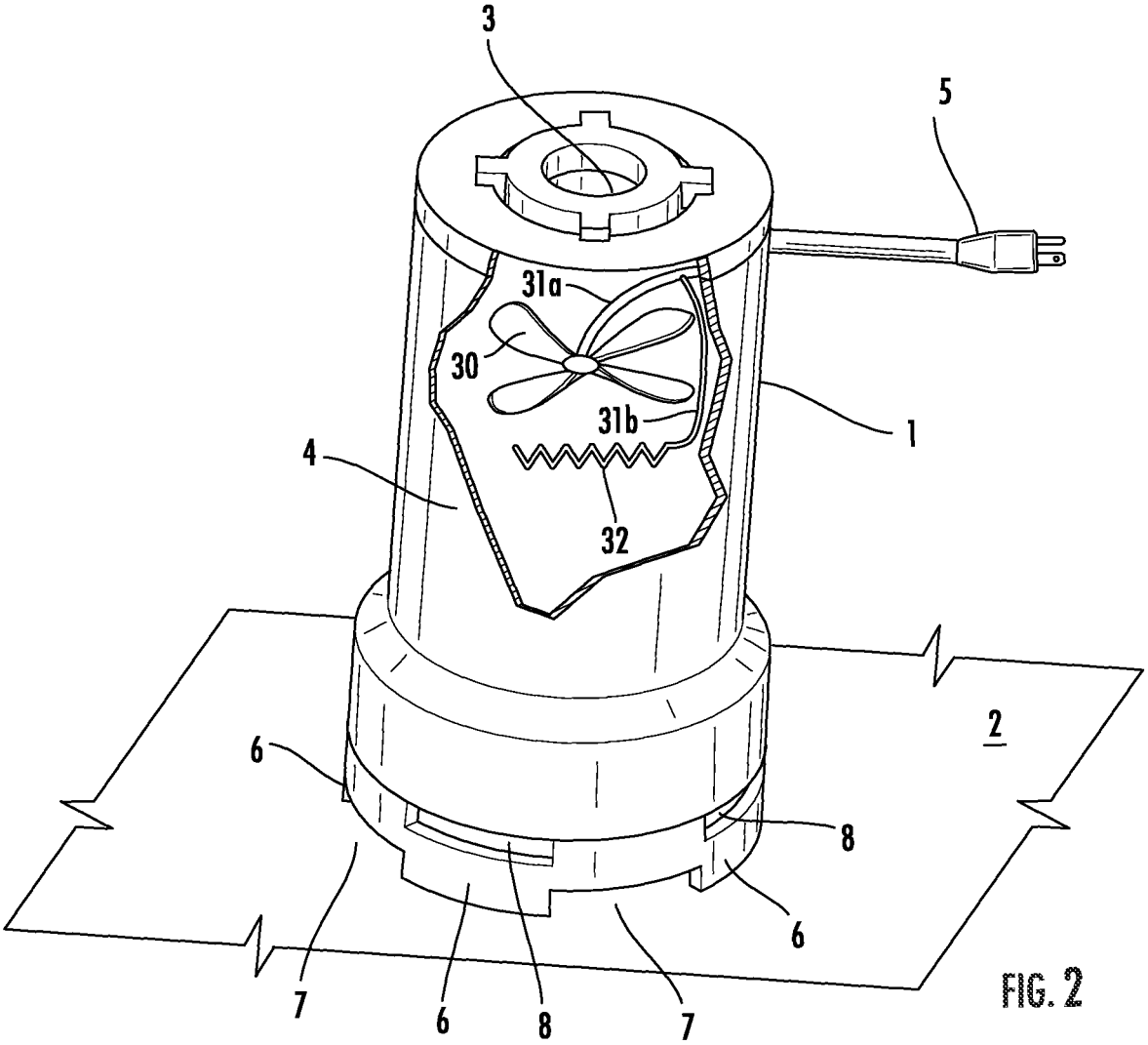
FIG. 2 is a cutaway view showing the heating element and fan of the present invention.
Figure 3:
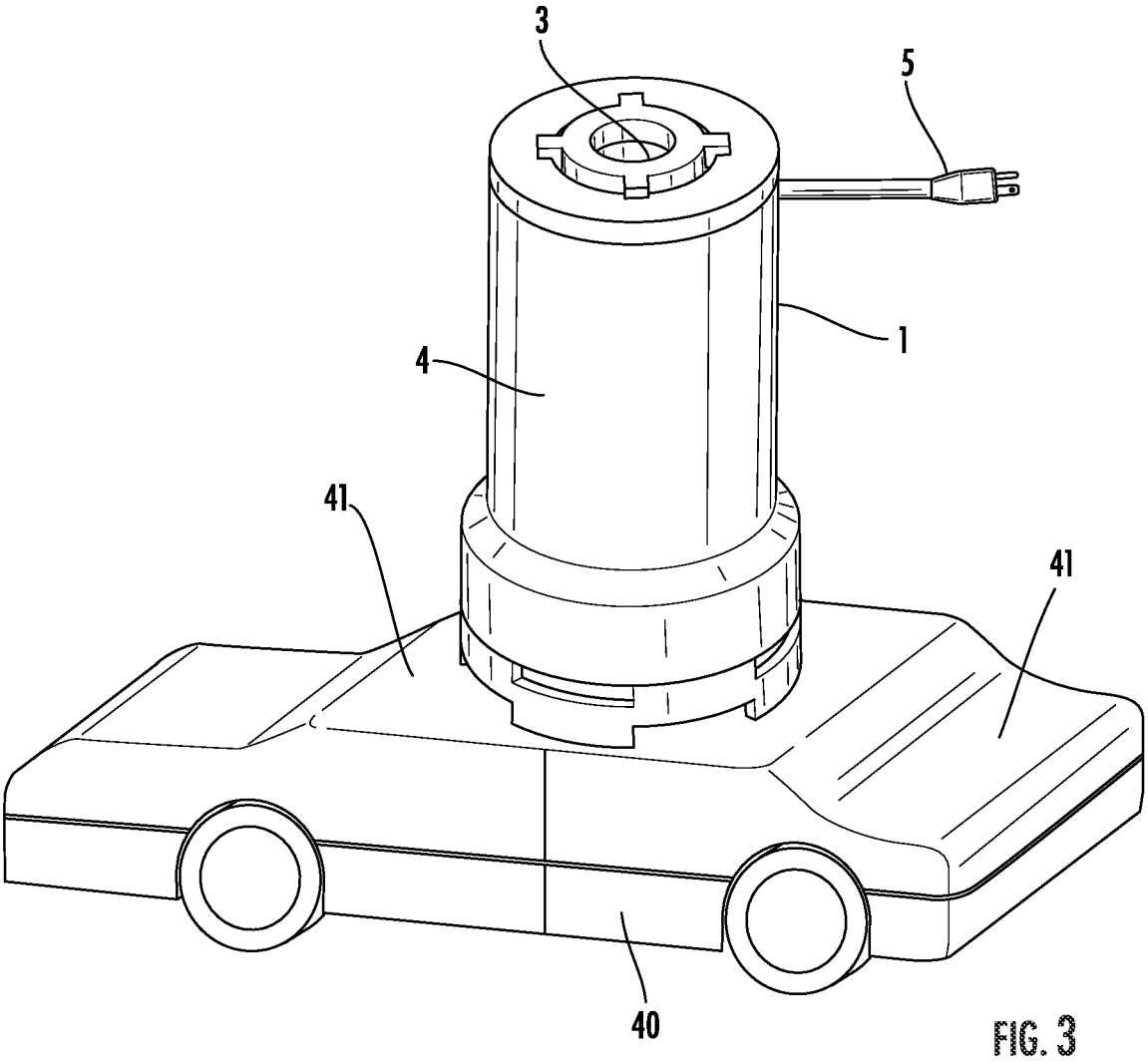
FIG. 3 is a view of the device of the present invention drying a model car.

In FIG. 2, we see a cutaway version of the hands-free drying device 1. In the cutaway, we can see inside the vertically oriented case 4. A downwardly oriented fan 30 powered from the AC source via the plug 5 and connecting wire 31*a* is shown above a resistor heating element 32 with connecting wire 31*b*. In FIG. 3, instead of a flat surface 2, there is a model car 40. As shown, it has enough horizontal portions 41 to accommodate the drying device, even though parts of the model car 40 are not even close to horizontal.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A hands-free device for drying an essentially horizontal surface which is not part of the device designed to dry the essentially horizontal surface consisting essentially of:

a) a heating element;

b) a fan oriented vertically to blow heat from the heating element vertically downward directly to the essentially horizontal surface;

c) a power source; and d) a vertically oriented case designed to sit directly on the essentially horizontal surface housing the fan and heating element and having a plurality of legs designed to create vent holes.

2. The hands-free device for drying an essentially horizontal surface according to claim 1 which is AC powered.

3. The hands-free device for drying an essentially horizontal surface according to claim 1 wherein the vertically oriented case is columnar.

4. The hands-free device for drying an essentially horizontal surface according to claim 1 wherein there are additional vent holes in the vertically oriented case.

5. The hands-free device for drying an essentially horizontal surface according to claim 1 wherein a temperature of the heat being blown downward is from about 50° C. to about 58° C.

6. The hands-free device for drying an essentially horizontal surface according to claim 1 wherein the device is positioned on a floor or carpet.

7. The hands-free device for drying an essentially horizontal surface according to claim 1 wherein the device is positioned over a painted article to be dried.

8. The hands-free device for drying an essentially horizontal surface according to claim 1 wherein the device is positioned over a model kit to be dried.

* * * * *